US005772786A

United States Patent [19]

De Smet et al.

[11] Patent Number: 5,772,786

[45] Date of Patent: Jun. 30, 1998

[54] DETERGENT COMPOSITION COMPRISING LIME SOAP DISPERSANT AND LIPASE ENZYMES

[75] Inventors: Beatrijs Lutgarde A. De Smet, Meise; Johan Gerwin L. Pluyter, Strombeek-Bever, both of Belgium; Lynda Anne Jones, Newcastle upon Tyne, Great Britain

[73] Assignee: The Procter & Gamble Company, Cincinnati, Ohio

[21] Appl. No.: 706,393

[22] Filed: Aug. 30, 1996

Related U.S. Application Data

[63] Continuation of Ser. No. 392,843, filed as PCT/US93/08875, Sep. 20, 1993 published as WO94/07984, Apr. 14, 1994, abandoned.

[30] Foreign Application Priority Data

Aug. 13, 1993 [EP] European Pat. Off. ..... 93870170

[51] Int. Cl.[6] ..... C11D 3/386; C11D 3/37; B08B 101/08

[52] U.S. Cl. ..... 134/25.2; 134/25.3; 510/220; 510/222; 510/223; 510/226; 510/393; 510/503; 510/475

[58] Field of Search ..... 510/220, 222, 510/223, 226, 228, 393, 503, 475; 134/25.3, 25.2

[56] References Cited

U.S. PATENT DOCUMENTS

| | | | |
|---|---|---|---|
| 4,075,118 | 2/1978 | Gault et al. | 252/135 |
| 4,339,342 | 7/1982 | Hempel et al. | 252/174.25 |
| 4,797,223 | 1/1989 | Amick et al. | 252/174.23 |
| 4,891,149 | 1/1990 | Nagarajan et al. | 252/110 |
| 4,932,287 | 6/1990 | Farin | 435/198 |
| 4,959,179 | 9/1990 | Aronson et al. | 252/135 |
| 5,069,809 | 12/1991 | Lagerwaard et al. | 252/174.12 |
| 5,078,898 | 1/1992 | Jars | 252/174.12 |
| 5,079,898 | 1/1992 | Jars | 252/174.12 |
| 5,153,135 | 10/1992 | Farin et al. | 435/253.3 |
| 5,278,066 | 1/1994 | Andreoli et al. | 435/252.34 |
| 5,545,346 | 8/1996 | MacBeath et al. | 510/514 |
| 5,545,356 | 8/1996 | Sadlowksi | 510/230 |
| 5,597,789 | 1/1997 | Sadlowski et al. | 510/230 |
| 5,629,278 | 5/1997 | Baeck et al. | 510/236 |

FOREIGN PATENT DOCUMENTS

| | | | |
|---|---|---|---|
| 0 271 153 A2 | 12/1987 | European Pat. Off. | C11D 3/386 |
| 0 271 155 A2 | 12/1987 | European Pat. Off. | C11D 3/386 |
| 0 346 136 B1 | 6/1989 | European Pat. Off. | C11D 3/386 |
| 0 373 850 B1 | 12/1989 | European Pat. Off. | C11D 3/386 |
| 0593841 | 4/1994 | European Pat. Off. . | |
| 8700859 | 2/1987 | WIPO . | |
| WO 87/00859 | 2/1987 | WIPO | C12N 9/20 |
| 9403592 | 2/1994 | WIPO . | |
| 9407984 | 4/1994 | WIPO . | |
| 9407985 | 4/1994 | WIPO . | |
| 9425578 | 10/1994 | WIPO . | |

OTHER PUBLICATIONS

Kalkseifendispergatoren, Tenside Sust. Det., vol. 27, pp. 159–161 (1990), Lindield.

Polymeric Lime Soap Dispersants, Cosmetics & Toiletries, vol. 104, pp. 71–73 (1989), Nogarajan et al.

*Primary Examiner*—Kery A. Fries

*Attorney, Agent, or Firm*—Ken K. Patel; Kim W. Zerby; Jacobus C. Rasser

[57] ABSTRACT

A method of cleaning soiled dishes comprising contacting said dishes with a composition comprising a lipased derived from pseudomonas pseudolacaligenes, a lime soap dispersant having an lime soapdispersing power of no more than eight, and a suds suppressing agent which contains either a silicone suds suppressing agent or a 2-alkyl alcanol suds suppressing agent.

9 Claims, No Drawings

DETERGENT COMPOSITION COMPRISING LIME SOAP DISPERSANT AND LIPASE ENZYMES

This a continuation of Ser. No. 08/392,843, abandoned, which is a continuation of application 371 PCT 93/08875 filed Sep. 20, 1993, published as WO94/07984, Apr. 14, 1994.

This invention relates to a machine dishwashing and rinsing detergent compositions containing lipolytic enzyme obtained from a lipase producing strain of *pseudomonas pseudoalcaligenes*, a lime soap dispersant, and preferably water-soluble detergent builder compound.

The overall performance of a machine dishwashing detergent product is judged by not only its ability to remove soils, particularly greasy soils, but also by its ability to prevent the redeposition of the soils, or the breakdown products of the soils or of any insoluble salts, on the articles being washed. The insoluble salts may be the calcium, magnesium or heavy metal ion—containing salts of the soils, or the breakdown products of the soils, or they may be purely inorganic in nature. Redeposition effects results in the articles being coated in an unseemly film, appearing streaked or being covered in visible spots which remain intact at the end of the wash process. Spotting, filming and streaking effects are visually most noticeable on glassware and on plastic articles.

The performance of a rinsing (or rinse aid) product is judged largely on its ability to prevent the, spotting, filming and streaking of the articles being rinsed. The ability to prevent the redeposition of soils which may have been carried over from the main wash step to the rinse step of the machine dishwashing process is therefore a key measure of the effectiveness of a rinse aid product.

Builder compounds are conventionally used in machine dishwashing and rinsing detergent products. Their principal action is to chelate magnesium and calcium ions. The magnesium and calcium ions may, in the absence of builder compounds or in underbuilt conditions, form insoluble salts which deposit as visible spots on the surfaces of the articles being washed. It is desirable that the builder compounds used in machine dishwashing detergent products are water-soluble since water insoluble builders compounds may also deposit on the articles being washed, remaining as visible spots at the end of the wash process.

For reasons of environmental compatibility it is desirable that machine dishwashing or rinsing detergent products are free from chlorine bleaches or phosphate builder compounds. However, spotting and filming effects are known to be a particular problem for machine dishwashing and rinsing products containing no chlorine bleach and/or no phosphate builder compound.

Lipolytic enzymes (lipases) are known to assist in the breakdown of triglyceride and fatty ester soils, and are therefore recognized as being of value as components of detergent compositions. Laundry detergent products containing lipase are commercialy available in Europe. Machine dishwashing and rinsing detergent compositions containing lipolytic enzyme have been disclosed, for example, in EP-B-0271555 and EP-A-0346136.

The disclosure of EP-B-0271155 teaches that the addition of lipases to a dishwashing or rinsing composition reduces significantly the formation of film or spots on the articles cleaned with such a composition. The disclosure of EP-A-0346136 teaches similar spotting and filming reductions for the inclusion of special lipases produced by cloning rDNA technologies into a machine dishwashing detergent composition.

The Applicants have however, now found that the inclusion of lipase enzyme into machine dishwashing or rinsing detergent compositions whilst providing a greasy stain removal benefit does not always provide spotting and filming prevention benefits. Indeed, it has unexpectedly been found that the inclusion of lipases into such compositions can in fact lead to enhanced spotting and filming, and in particular to significantly enhanced film formation on plastic articles.

The Applicants have also established that adverse spotting and filming effects may be significantly reduced by the inclusion, in addition to the lipolytic enzyme, of a lime soap dispersant into a machine dishwashing or rinsing composition. In particular, the aforementioned specific problem of film formation on plasticware is ameliorated by the inclusion of the lime soap dispersant.

The inclusion of a lime soap dispersant in the machine dishwashing or rinsing compositions moreover, does not appear to lead to any significant reduction in the greasy soil removal performance of the lipolytic enzyme-containing machine dishwashing or rinsing composition.

A lime soap dispersant is a material that prevents the precipitation of alkali metal, ammonium or amine salts of fatty acids by calcium or magnesium ions. Some, but not all, lime soap dispersants also demonstrate surfactant capability. Conversely, not all surfactants may act as effective lime soap dispersants. It is, however, desirable in the detergent compositions of the invention that the lime soap dispersant also has surface active (surfactant) capability.

It is an object of the present invention to provide detergent compositions containing a specific lipolytic enzyme, obtained from a lipase producing strain of *pseudomonas pseudoalcaligenes*, which include a compound which demonstrates good lime soap dispersant capability wherein the compositions provide the mitigation of spotting and filming effects, particularly on glassware and plasticware, when used in machine dishwashing or rinsing processes.

The machine dishwashing or rinsing detergent compositions of the present invention are of particular value when formulated as compositions containing no chlorine bleach and no phosphate builder compound since they provide the abovementioned mitigation of spotting and filming effects for these formulations where spotting and filming is known to be a particular problem.

According to the present invention there is provided a detergent composition suitable for use in a machine dishwashing or rinsing process containing a) from 0.1% to 40% by weight of a lime soap dispersant compound having a lime soap dispersant power of no more than 8; and (b) from 0.001% to 2% by weight of active lipolytic enzyme, obtained from a lipase producing strain of *pseudomonas pseudoalcaligenes.*

Preferably, the composition contains water-soluble detergent builder compound.

Preferably, the detergent builder compound is a non-phosphate detergent builder compound. Preferably, the composition is free from chlorine bleach.

According to another aspect of the present invention there is also provided a machine dishwashing or rinsing process comprising treating soiled articles selected from crockery, glassware,hollowware and cutlery and mixtures thereof, with an aqueous liquid having dissolved or dispensed therein an effective amount of the machine dishwashing or rinsing composition as described hereinabove. By an effective amount of the machine dishwashing composition it is meant from 8 g to 60 g of product, and by an effective amount of the rinsing composition it is meant from 0.5 g to 15 g of product, dissolved or dispersed in a wash solution of volume from 3 to 10 liters, as are typical product dosages and wash solution volumes commonly employed in conventional machine dishwashing or rinsing processes.

The machine dishwashing or rinsing detergent compositions of the present invention preferably contain detergent builder compound present at a level of from 1% to 80% by weight, preferably from 10% to 70% by weight, most preferably from 20% to 60% weight of the composition. The detergent builder compound is most preferably water-soluble.

Suitable water-soluble detergent builder compounds include, but are not restricted to monomeric polycarboxylates, of their acid forms homo or copolymeric polycarboxylic acids or their salts in which the polycarboxylic acid comprises at least two carboxylic radicals separated from each other by not more that two carbon atoms, carbonates, bicarbonates, borates, phosphates, silicates and mixtures of any of the foregoing.

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5. The logarithmic acidity constant is defined by reference to the equilibrium $H^+ + A^- \rightleftarrows HA$ where A is the fully ionized carboxylate anion of the builder salt.

The equilibrium constant for dilute solutions is therefore given by the expression $$K_1 = \frac{[HA]}{[H^+]\ [A^-]}$$

and $pK_1 = \log_{10} K$.

For the purposes of this specification, acidity constants are defined at 25° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

The carboxylate or polycarboxylate builder can be momomeric or oligomeric in type although monomeric polycarboxylates are generally preferred for reasons of cost and performance.

Monomeric and oligomeric builders can be selected from acyclic, alicyclic, heterocyclic and aromatic carboxylates having the general formulae

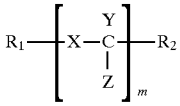

(a)

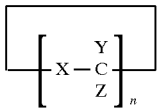

(b)

or (c)

wherein $R_1$ represents H, $C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H, $C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy;hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6; and wherein, X, Y, and Z each have the same or different representations when repeated in a given molecular formula, and wherein at least one Y or Z in a molecule contain a carboxyl group.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis, cis, cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. These materials are normally used at levels of from 0.5% to 10% by weight more preferably from 0.75% to 8%, most preferably from 1% to 6% by weight of the composition.

Water-soluble detergent builders include, but are not limited to, the alkali metal, ammonium and alkanolammonium salts of polyphosphates (exemplified by the tripolyphosphates, pyrophosphates, and glassy polymeric meta-phosphates), phytic acid, silicates, carbonates (including bicarbonates and sesquicarbonates), and sulfates. Borate builders, as well as builders containing borate-forming materials that can produce borate under detergent storage or wash conditions can also be used but are not preferred at wash conditions less that about 50° C., especially less than about 40° C.

Examples of carbonate builders are the alkaline earth and alkali metal carbonates, including sodium carbonate and sesqui-carbonate and mixtures thereof with ultra-fine calcium carbonate as disclosed in German Patent Application No. 2,321,001 published on Nov. 15, 1973.

Specific examples of phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Suitable silicates include the water soluble sodium silicates with an $SiO_2$: $Na_2O$ ratio of from 1.0 to 2.8, with ratios of from 1.6 to 2.4 being preferred, and 2.0 ratio being most preferred. The silicates may be in the form of either the anhydrous salt or a hydrated salt. Sodium silicate with an $SiO_2$: $Na_2O$ ratio of 2.0 is the most preferred silicate.

Silicates are preferably present in the machine dishwashing detergent compositions at the invention at a level of from 5% to 50% by weight of the composition, more preferably from 10% to 40% by weight.

Whilst water-soluble detergent builders are preferred components of the detergent compositions of the invention the compositions may also include less water soluble builders although preferably their levels of incorporation are minimized. Examples of such less water soluble builders include the crystalline layered silicates and the largely water insoluble sodium aluminosilicates.

Crystalline layered sodium silicates have the general formula $$NaMSi_xO_{x+1.y}H_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. More preferably M is sodium and y is 0 and preferred examples of this formula comprise the α-, β-, γ- and δ- forms of $Na_2Si_2O_5$. These materials are available from Hoechst AG FRG as respectively NaSKS-5, NaSKS-7, NaSKS-11 and NaSKS-6. The most preferred material is —$Na_2Si_2O_5$, NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof. The primary requirement is that the material should contain at least on functional acidic group of which the pKa should be less than 9, providing a capability for at least partial neutralisation of the hydroxyl ions released by the crystalline layered silicate.

The incorporation in the particulate of other ingredients additional to the crystalline layered silicate and ionisable water soluble compound can be advantageous particularly in the processing of the particulate and also in enhancing the stability of detergent compositions in which the particulates are included. In particular, certain types of agglomerates may require the addition of one or more binder agents in order to assist in binding the silicate and ionisable water soluble material so as to produce particulates with acceptable physical characteristics.

The crystalline layered sodium silicate containing particulates can take a variety of physical forms such as extrudates, marumes, agglomerates, flakes or compacted granules. A preferred process for preparing compacted granules comprising crystalline layered silicate and a solid, water-soluble ionisable material has been disclosed in the commonly assigned British Application No. 9108639.7 filed on 23 Apr. 1991 (Attorney's Docket No CM369F).

Suitable aluminosilicate zeolites have the unit cell formula $Na_z[(AlO_2)_z(SiO_2)_y]$. $XH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/litre [4 grains/gallon/minute/(gram/gallon)], based on calcium ion hardness.

Optimum aluminosilicates for builder purpose exhibit a calcium ion exchange rate of at least 260 mg equivalent of $CaCO_3$/liter/minute/(gram/liter) [4 grains/gallon/minute/(gram/gallon)].

The aluminosilicate ion exchange materials can be naturally occurring materials, but are preferably synthetically derived. A method for producing aluminosilicate ion exchange materials is discussed in U.S. Pat. No. 3,985,669. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}[AlO_2)_{12}(SiO_2)_{12}]\cdot xH_2O$$

wherein x is from 20 to 30, especially 27. Zeolite X has the formula $Na_{86}$ $[(AlO_2)_{86}(SiO_2)_{106}]$. 276 $H_2O$ has the formula $Na_6$ $[(AlO_2)_6(SiO_2)_6]7.5$ $H_2O$).

The first essential component of the machine dishwashing or rinsing compositions of the invention is a lime soap dispersant compound, which has a lime soap dispersing power (LSDP), as defined hereinafter of no more than 8, preferably no more than 7, most preferably no more than 6. The lime soap dispersant compound is present at a level of from 0.1% to 40% by weight, more preferably 1% to 20% by weight, most preferably from 2% to 10% by weight of the compositions.

A lime soap dispersant is a material that prevents the precipitation of alkali metal, ammonium or amine salts of fatty acids by calcium or magnesium ions. A numerical measure of the effectiveness of a lime soap dispersant is given by the lime soap dispersing power (LSDP) which is determined using the lime soap dispersion test as described in an article by H. C. Borghetty and C. A. Bergman, J. Am. Oil. Chem. Soc., volume 27, pages 88–90, (1950). This lime soap dispersion test method is widely used by practitioners in this art field being referred to , for example, in the following review articles; W. N. Linfield, Surfactant Science Series, Volume 7, p3; W. N. Linfield, Tenside Surf. Det. , Volume 27, pages 159–161, (1990); and M. K. Nagarajan, W. F. Masler, Cosmetics and Toiletries, Volume 104, pages 71–73, (1989). The LSDP is the % weight ratio of dispersing agent to sodium oleate required to disperse the lime soap deposits formed by 0.025 g of sodium oleate in 30 ml of water of 333ppm $CaCO_3$ (Ca:Mg=3:2) equivalent hardness.

In the Borghetty/Bergman lime soap dispersion test 5 ml of a 0.5% by weight solution of sodium oleate is added to a test tube, followed by loml of a hard water solution containing 600 ppm $Ca^{2+}$ and 400 ppm $Mg^{2+}$ (1000 ppm as $CaCO_3$ equivalent, 700 ° Clark Hardness) which will cause formation of a lime soap deposit (or curd). An arbitrary amount (less than 15 ml) of dispersing agent as a 0.25% by weight solution is then added to the test tube. The total volume of solution in the test tube is then made up to 30 ml and the test tube is stoppered, inverted 20 times and then allowed to stand for 30 seconds. The contents of the test tube are then visually inspected to check if the lime soap deposits are still intact or whether they have been dispersed into the solution. The test procedure is repeated using different amounts of dispersing agent solution until the minimum amount of dispersing agent solution which will cause dispersion of the lime soap deposits is obtained.

The lime soap dispersing power is then obtained as:

$$LSDP = \frac{\text{(weight of lime soap dispersing agent)}}{\text{(weight of sodium oleate)}} \times 100$$

Thus in accord with the test method described above a material with a lower LSDP is a more effective lime soap dispersant than one with a higher LSDP.

A listing of suitable lime soap dispersants for use in accord with the invention is given in the above mentioned review by M. Linfield to be found in Tenside. Sust. Det., Volume 27, pages 159–161 (1990).

Polymeric lime soap dispersants suitable for use herein are described in the above mentioned article by M. K. Nagarajan and W. F. Masler, to be found in Cosmetics and Toiletries, Volume 104, pages 71–73, (1989). Examples of such polymeric lime soap dispersants include certain water-soluble salts of copolymers of acrylic acid, methacrylic acid or mixtures thereof, and an acrylamide or substituted acrylamide, where such polymers typically have a molecular weight of from 5,000 to 20,000.

Surfactants having good lime soap dispersant capability will include certain amine oxides, betaines, sulfobetaines, alkyl ethoxysulfates and ethoxylated alcohols.

Exemplary surfactants having a LSDP of no more than 8 for use in accord with the invention include $C_{16}$–$C_{18}$ dimethyl amine oxide, $C_{12}$–$C_{18}$ alkyl ethoxysulfates with an average degree of ethoxylation of from 1–5, particularly $C_{12}$–$C_{15}$ alkyl ethoxysulfate surfactant with a degree of ethoxylation of about 3 (LSDP=4), and the $C_{13}$–$C_{15}$ ethoxylated alcohols with an average degree of ethoxylation of either 12 (LSDP=6) or 30, sold under the trade names Lutensol A012 and Lutensol A030 respectively, by BASF GmbH.

The second essential component of the machine dishwashing or rinsing detergent compositions in accord with the invention is lipolytic enzyme, obtained from a lipase producing strain of *Pseudomonas pseudoalcaligenes* present at levels of active lipolytic enzyme of from 0.001% to 2% by weight, preferably 0.001% to 1% by weight, most preferably from 0.001% to 0.5% by weight of the compositions.

The lipase is bacterial in origin being obtained from a lipase producing strain of *Pseudomonas pseudoalcaliaenes*.

The lipase is derived from *Pseudomonas pseudoalcaligenes*, which is described in Granted European Patent, EP-B-0218272.

The lipolytic enzyme herein has acceptable compatibility with surfactants and has high activity at alkaline pH. The cleaning performance of the composition is enhanced by the addition of the lipolytic enzyme.

A lipase unit (LU) is defined as the amound of lipase which produces 1 umol of titratable butyric acid per minute in a pH stat, where pH is 7.0, temperature is 30° C., and substrate is an emulsion of ributyrin and gum arabic in the presence of $Ca^{++}$ and NaCl in phosphate buffer.

A highly preferred component of the machine dishwashing or rinsing compositions of the invention is a surfactant system comprising surfactant selected from anionic, cationic, nonionic ampholytic, amphoteric and zwitterionic surfactants and mixtures thereof. The surfactant system is present at a level of from 0.1% to 50% by weight, more preferably 1% to 25% by weight, most preferably from 2% to 20% by weight of the compositions.

The surfactant system is preferably formulated to be compatible with enzyme components present in the composition. In liquid or gel compositions the surfactant system is most preferably formulated such that it promotes, or at least does not degrade, the stability of enzyme in these compositions.

A typical listing of anionic, nonionic, ampholytic, and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31, 1981.

Anionic Surfactant

The anionic surfactant may be essentially any anionic surfactant, including anionic sulfate, sulfonate or carboxylate surfactant.

Highly preferred anionic surfactants herein are sodium or potassium salt-forms for which the corresponding calcium salt form has a low Krafft temperature of for example 30 deg. C. or below, or, even better, 20 deg. C. or lower. Without being limited by theory, including anionic surfacants, the calcium salts of which have low Krafft temperatures, into the surfactant systems in accord with the present invention tends to minimize film formation on hard surfaces. Thus such anionic surfactants may act such as to complement the spotting/filming preventative action of the lime soap dispersant components of the compositions in accord with the present invention. Examples of such highly preferred anionic surfactants are the alkyl(polyethoxy) sulfates.

Anionic Sulfate Surfactant

The anionic sulfate surfactant may be any organic sulfate surfactant. It is preferably selected from the group consisting of $C_6$–$C_{18}$ alkyl sulfate which has been ethoxylated with from about 0.5 to about 20 moles of ethylene oxide per molecule, $C_9$–$C_{17}$ acyl—N—($C_1$–$C_4$ alkyl) glucamine sulfated, —N—($C_2$–$C_4$ hydroxyalkyl) glucamine sulfate, and mixtures thereof. More preferably, the anionic sulfate surfactant is a $C_6$–$C_{18}$ alkyl sulfate which has been ethoxylated with from about 0.5 to about 20, preferably from about 0.5 to about 5, moles of ethylene oxide per molecule.

Preferred alkyl ethoxy sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$ alcohol itself is preferable commercially available. $C_{12}$–$C_{15}$ alkyl sulfate which has been ethoxylated with from about 1 to about 5 moles of ethylene oxide per molecule is preferred.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Anionic sulfate surfactants include the $C_5$–$C_{17}$ acyl—N—($C_1$–$C_4$ alkyl) and —N—($C_1$–$C_2$ hydroxyalkyl) glucamine sulfates, preferably those in which the $C_5$–$C_{17}$ acyl group is derived from coconut or palm kernel oil. These materials can be prepared by the method disclosed in U.S. Pat. No. 2,717,894, Schwartz, issued Sep. 13, 1955.

The counterion for the anionic sulfate surfactant component is preferably selected from calcium, sodium, potassium, magnesium, ammonium, or alkanol-ammonium, and mixtures thereof.

Anionic Sulfonate Surfactant

Anionic sulfonate surfactants suitable for use herein include essentially any sulfonate surfactants including, for example, the salts (eg : alkali metal salts) of $C_5$–$C_{20}$ linear alkylbenzene sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, paraffin sulfonates, and any mixtures thereof.

Anionic Alkyl Ethoxy Carboxylate Surfactant

Alkyl ethoxy carboxylates suitable for use herein include those with the fomula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than about 20%, preferably less than about 15%, most preferably less than about 10%, and the amount of material where x is greater than 7, is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation, preferably chosen from alkali metal, alkaline earth metal, ammonium, mono-, di-, and tri-ethanol-ammonium, most preferably from sodium, potassium, ammonium and mixtures thereof with magnesium ions. The preferred alkyl ethoxy carboxylates are those where R is a $C_{12}$ to $C_{18}$ alkyl group.

Anionic Alkyl Polvethoxy Polycarboxylate Surfactant

Alkyl polyethoxy polcarboxylate surfactants suitable for use herein include those having the formula:

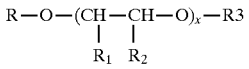

wherein R is a $C_6$ to $C_{18}$ alkyl group, x is from 1 to 25, $R_1$, and $R_2$ are selected from the group consisting of hydrogen, methyl acid radical, succinic acid radical, hydroxysuccinic acid radical, and mixtures thereof, wherein at least one $R_1$, or $R_2$ is a succinic acid radical or hydroxysuccinic acid radical, and $R_3$ is selected from the group consisting of hydrogen, substituted or unsubstituted hydrocarbon having between 1 and 8 carbon atoms, and mixtures thereof.

Alkali Metal Sarcosinate Surfactant

Other anionic surfactants suitable for the purposes of the invention are the alkali metal sarcosinates of formula $R—CON(R^1)CH_2COOM$ wherein R is a $C_5$–$C_{17}$ linear or branched alkyl or alkenyl group, $R^1$ is a $C_1$–$C_4$ alkyl group and M is an alkali metal ion. Preferred examples are the myristyl and oleyl methyl sarcosinates in the form of their sodium salts.

Alkyl Ester Sulphonate Surfactants

Another class of anionic surfactants useful herein are the alkyl ester sulfonate surfactants which include linear esters of $C_8$–$C_{20}$ carboxylic acids (i.e., fatty acids) which are sulfonated with gaseous S03 according to "The Journal of the American Oil Chemists Society," 52 (1975), pp. 323–329. Suitable starting materials would include natural fatty substances as derived from tallow, palm oil, etc.

The preferred alkyl ester sulfonate surfactants have the structural formula:

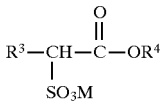

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{18}$ alkyl, and $R^4$is methyl, ethyl or isopropyl. Especially preferred are the methyl ester sulfonates wherein $R^3$ is $C_{10}$–$C_{18}$ alkyl.

Other Anionic Surfactants

Other anionic surfactants useful for detersive purposes can also be included in the compositions hereof. These can include salts (including, for example, sodium, potassium, ammonium, and substituted ammonium salts such as mono-, di- and triethanolamine salts) of fatty oleyl glycerol sulfates, alkyl phenol ethylene oxide ether sulfates, alkyl phosphates, isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described herein), branched primary alkyl sulfates, alkyl polyethoxy carboxylates such as those of the formula $RO(CH_2CH_2O)_kCH_2COO—M^+$ wherein R is a $C_8$–$C_{22}$ alkyl-, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Nonionic Surfactant

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, nonlimiting classes of useful nonionic surfactants are listed below.

Nonionic Polyhydroxy Fatty Acid Amide Surfactant

Polyhydroxy fatty acid amides suitable for use herein are those having the structural formula:

$$R^2-\overset{\overset{\displaystyle O}{\|}}{C}-\overset{\overset{\displaystyle R^1}{|}}{N}-Z \qquad (I)$$

wherein: R1 is H, $C_1$–$C_4$ hydrocarbyl, 2-hydroxy ethyl, 2-hydroxy propyl, or a mixture thereof, preferable $C_1$–$C_4$ alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_9$ alkyl or alkenyl, more preferably straight-chain $C_9$–$C_{17}$ alkyl or alkenyl, most preferably straight-chain $C_{11}$–$Cl_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—CH2—$OH_2$, —$CH(CH_2OH)$—$(CHOH)_n$—, 13 $CH_2OH$, —$CH_2$—$(CHOH)_2(CHOR')(CHOH)$—$CH_2OH$, where n is an integer from 3 to 5, inclusive, and R' is H or a cyclic or aliphatic monosaccharide, and alkoxylate derivative thereof. Most preferred are glycityls wherein n is 4, particularly —$CH_2$—$(CHOH)_4$—$CH_2OH$.

In Formula (I), $R^1$ can be, for example, N-methyl, N-ethyl, N-propyl, N-isopropyl, N-butyl, N-2-hydroxy ethyl, or N-2-hydroxy propyl. R2—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula:

$$R^2\overset{\overset{\displaystyle OCH_3}{\|}}{C}N-CH_2-(CHOH)_4CH_2OH$$

wherein $R^2$ is a straight chain $C_{11}$–$C_{17}$ alkyl or alkenyl group.

Nonionic Condensates of Alkyl Phenols

The polyethylene, polypropylene, and polybutylene oxide condensates of alkyl phenols are suitable for use herein. In general, the polyethylene oxide condensates are preferred. These compounds include the condensation products of alkyl phenols having an alkyl group containing from about 6 to about 18 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company.

Nonionic Ethoxylated Alcohol Surfactant

The alkyl ethoxylate condensation products of aliphatic alcohols with from about 1 to about 25 moles of ethylene oxide are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from about 2 to about 10 moles of ethylene oxide per mole of alcohol. Most preferred are the condensation products of alcohols having an alkyl group containing from 12 to 18 carbon atoms with from about 6 to about 10 moles of ethylene oxide per mole of alcohol. Examples of commercially available nonionic surfactants of this type include Tergitol™ 15-S-9 (the condensation product of $C_{11}$–$C_{15}$ linear alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23–6.5 (the condensation product of $C_{12}$–$C_{13}$ linear alcohol with 6.54 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOBN (the condensation product of $C_{13}$–$C_5$ alcohol with 9 moles ethylene oxide), marketed by The Procter & Gamble Company.

Nonionic Ethoxylated/propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 3 to 50, most preferably these are the $C_{12}$–$C_{18}$ ethoxylated fatty alcohols with a degree of ethoxylation from 3 to 40. Preferably the mixed ethoxylated/propoxylated fatty alcohols have an alkyl chain length of from 10 to 18 carbon atoms, a degree of ethoxylation of from 3 to 30 and a degree of propoxylation of from 1 to 10.

Nonionic EO/PO Condensates with Propylene Glycol

The condensation products of ethylene oxide with a hydrophobic base formed by the condensation of propylene oxide with propylene glycol are suitable for use herein. The hydrophobic portion of these compounds preferably has a molecular weight of from about 1500 to about 1800 and exhibits water insolubility. The addition of polyoxyethylene moieties of this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.

Nonionic EO Condensation Products with Propylene Oxide/ethylene diamine Adducts

The condensation products of ethylene oxide with the product resulting from the reaction of propylene oxide and ethylenediamine are suitable for use herein. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from 8 to 18, preferably from 10 to 16, carbon atoms. Preferably, the alkyl group is a straight-chain saturated alkyl group. The alkyl group can contain up to about 3 hydroxyl groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galatoses. Suitable mixtures include coconut alkyl, di-, tri-, tetra-, and pentaglucosides and tallow alkyl tetra-, penta- and hexaglucosides.

The preferred alkylpolyglycosides have the formula $$R^2O(C_nH_{2n}O)t(\text{glycosyl})_x$$

wherein R2 is selected from the group consisting of alkyl, alkylphenyl, hydroxyalkyl, hydroxyalkylphenyl, and mixtures thereof in which the alkyl groups contain from 10 to 18, preferably from 12 to 14, carbon atoms; n is 2 or 3, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-,3-, 4- and/or 6-position, preferably predominantly the 2-position.

Nonionic Fatty Acid Amide Surfactant

Fatty acid amide surfactants suitable for use herein are those having the formula:

$$R^6-\overset{\overset{\displaystyle O}{\|}}{C}-N(R^7)2$$

wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Ampholytic Surfactant

Ampholytic surfactants can be incorporated into the detergent compositions herein. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants.

Amphoteric Surfactant

Alkyl Amphocarboxylic Acid Amphoteric Surfactant

Suitable amphoteric surfactants for use herein include the alkyl amphocarboxylic acids of the formula $$RC(=O)-NHCH_2CH_2Ri$$

wherein R is a $C_8$–$C_{18}$ alkyl group, and $R_i$ is of the general formula

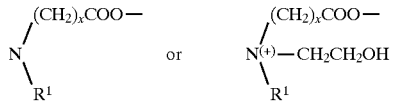

wherein $R^1$ is a $(CH_2)_xCOOM$ or $CH_2CH_2OH$, and x is 1 or 2 and M is preferably chosen from alkali metal, alkaline earth metal, ammonium, mono-, di-, and triethanolammonium, most preferably from sodium, potassium, ammonium and mixtures thereof with magnesium ions. The preferred R alkyl chain length is a $C_{10}$ to $C_{14}$ alkyl group. A preferred amphocarboxylic acid is produced from fatty imidazolines wherein the dicarboxylic acid functionality of the amphodicarboxylic acid is diacetic acid and/or dipropionic acid. A suitable example of an alkyl aphodicarboxylic acid for use herein in the amphoteric surfactant Miranol(TM) C2M Conc. manufactured by Miranol, Inc., Dayton, N.J.

Amine Oxide surfactant

Amine oxides useful in the present invention include those compounds having the formula:

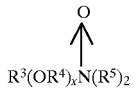

wherein $R^3$ is selected from an alkyl, hydroxyalkyl, acylamidopropoyl and alkyl phenyl group, or mixtures thereof, containing from 8 to 26 carbon atoms, preferably 8 to 16 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydyroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{18}$ alkoxy ethyl dihydroxyethyl amine oxides. Examples of such materials include dimethyloctylamine oxide, diethyldecylamine oxide, bis- (2-hydroxyethyl) dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$–$C_{18}$ alkyl dimethylamine oxide, and $C_{10-18}$ acylamido alkyl dimethylamine oxide.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 (herein incorporated by reference) for examples of zwitterionic surfactants.

Betaine Surfactant

The betaines useful herein are those compounds having the formula $R(R')_2N^+R^2COO^-$ wherein R is a $C_6$–$C_{18}$ hydrocarbyl group, preferably a $C_{10}$–$C_{16}$ alkyl group or $C_{10-16}$ acylamido alkyl group, each $R^1$ is typically $C_1$–$C_3$ alkyl, preferably methyl,m and $R^2$ is a $C_1$–$C_5$ hydrocarbyl group, preferably a $C_l$–$C_3$ alkylene group, more preferably a $C_1$–$C_2$ alkylene group. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1-carboxybutane; $C_{16-18}$ acylamidodimethylbetaine; $C_{12-16}$ acylamidopentanediethyl-betaine; [$C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines.

Sultaine Surfactant

The sultaines useful herein are those compounds having the formula $(R(R^1)_2N^+R^2SO_3^-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12-14}$ amido propyl ammonio-2-hydroxypropyl sultaine, $C_{12-14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

Complex Betaine Surfactant

The complex betaines for use herein have the formula

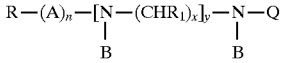

(I)

wherein R is a hydrocarbon group having from 7 to 22 carbon atoms, A is the group (C(O)), n is 0 or 1, $R_1$ is hydrogen or a lower alkyl group, x is 2 or 3, y is an integer of 0 to 4, Q is the group $-R_2COOM$ wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

An example in this category is tallowamphopolycarboxy glycinate, of the formula:

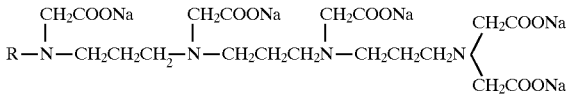

Preferred amides are $C_8$–$C_{20}$ alkyl mono- or di-$C_2$–$C_3$ alkanolamides, especially monoethanolamides, diethanolamides, and isopropanolamides.

Ampholytic, amphoteric and zwitteronic surfactants are generally used in combination with one or more anionic and/or nonionic surfactants.

Cationic Surfactants

Cationic surfactants can also be used in the detergent compositions herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Hydrotropes

A hydrotrope is typically added to the compositions of the present invention, and may be present at levels of from 0.5% to 25%, preferably from 1% to 15%, by weight. Useful hydrotropes include sodium, potassium, and ammonium xylene sulfonates, sodium, potassium, and ammonium toluene sulfonate, sodium potassium and ammonium cumene sulfonate, and mixtures thereof.

Other compounds useful as hydrotropes herein include polycarboxylates. Some polycarboxylates have calcium chelating properties as well as hydrotropic properties. Particularly useful hydrotropes are alkylpolyethoxy polycarboxylate surfactants of the type as previously described herein.

An example of a commercially available alkylpolyethoxy polycarboxylate which can be employed herein is POLY-TERGENT C, Olin Corporation, Cheshire, Conn.

Another compound useful as a hydrotrope is alkyl amphodicarboxylic acid of the generic formula:

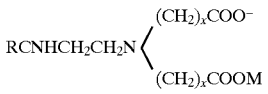

wherein R is a $C_8$ to $C_{18}$ alkyl group, x is from 1 to 2, M is preferably chosen from alkali metal, alkaline earth metal, ammonium, mono-, di-, and tri-ethanolammonium, most preferably from sodium, potassium, ammonium, and mixtures thereof with magnesium ions. The preferred alkyl chain length (R) is a $C_{10}$ to $C_{14}$ alkyl group and the dicarboxylic acid functionally is diacetic acid and/or dipropionic acid.

A suitable example of an alkyl amphodicarboxylic acid is the amphoteric surfactant Miranol R 2CM Conc.manufactured by Miranol, Inc., Dayton, N.J.

Suds Suppressing System

The machine dishwashing or rinsing detergent compositions of the invention preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl alcanol antifoam compounds, and paraffin antifoam compounds.

By antifoam compound it is meant herein any compound or mixtures of compounds which act such as to depress the foaming or sudsing produced by a solution of a detergent composition, particularly in the presence of agitation of that solution.

The suds suppressing system may be incorporated into the detergent compositions by essentially any process route. One preferred suds suppressing system comprises in combination a spray-on component and a particulate component.

Preferred spray-on components comprise in combination an antifoam compound and a carrier fluid and optionally a dispersant compound. The antifoam compound is dissolved, dispersed, suspended or emulsified in said carrier fluid. The carrier fluid should be inert in nature, that is it should not undergo undesirable chemical reaction with the antifoam compound, and also preferably be storage stable under normal atmospheric conditions and in the environment of a granular detergent matrix.

Any spray-on component is incorporated into the granular detergent compositions of the invention by a spray-on process, that is a process whereby the fluid is sprayed on to some or all of the individual granular components of the composition. Highly preferably the spray-on process will be such as to provide a uniform and sufficient application of the suds suppressing component to any granular components of the composition which comprise a high sudsing surfactant.

A preferred composition for a spray-on component comprises (a) antifoam compound, preferably silicone antifoam compound, most preferably a silicone antifoam compound comprising in combination
   (i) polydimethyl siloxane, at a level of from 50% to 99%, preferably 75% to 95% by weight of the silicone antifoam compound; and
   (ii) silica, at a level of from 1% to 50%, preferably 5% to 25% by weight of th e si licone/silica antifoam compound;

wherein said silica/silicone antifoam compound is incorporated at a level of from 5% to 50%, preferably 10% to 40% by weight of the spray-on component;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight of the spray-on component; a particularly preferred silicone glycol rake copolymer of this type is DCO544, commercially available from DOW Corning;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight of the spray-on component;

Any spray on component of the suds suppressing system may be incorporated as such, or in a preferred execution may be mixed with other components such as liquid nonionic surfactants, and perfume, and this mixture sprayed on as a whole.

Particulate components of the suds suppressing system are particulate in form and incorporated into the compositions of the invention in this form.

By particulate form it is meant essentially any of the particulate forms which may be typically adapted by a component of a granular detergent composition. The particulate component can therefore be, for example, in the form of granules, flakes, prills, marumes or noodles. In a preferred execution the particulate is granular in nature. Granules themselves may be agglomerates formed by pan or drum agglomeration or by an in-line mixer, and also may be spray-dried particles produced by atomising an aqueous slurry of the ingredients in a hot air stream which removes most of the water. The spray dried granules are then subjected to densification steps, eg : by high speed cutter mixers and/or compacting mills, to increase density before being reagglomerated.

Any particulate component of the suds suppressing system may comprise in combination antifoam compound, and a carrier material which is highly preferably water-soluble or water-dispersible in nature.

A suitable particulate antifoam component useful in the compositions herein comprises a mixture of an alkylated siloxane of the type hereinabove disclosed and solid silica.

The solid silica can be a fumed silica, a precipitated silica or a silica, made by the gel formation technique. The silica particles suitable have an average particle size of from 0.1 to 50 micrometers, preferably from 1 to 20 micrometers and a surface area of at least 50 $m^2/g$. These silica particles can be rendered hydrophobic by treating them with dialkylsilyl groups and/or trialkylsilyl groups either bonded directly onto the silica or by means of a silicone resin. It is preferred to employ a silica the particles of which have been rendered hydrophobic with dimethyl and/or trimethyl silyl groups. A preferred particulate antifoam compound for inclusion in the detergent compositions in accordance with the invention suitably contain an amount of silica such that the weight ratio of silica to silicone lies in the range from 1:100 to 3:10, p preferably from 1:50 to 1:7.

Another suitable particulate antifoam component is represented by a hydrophobic silanated (most preferably trimethyl-silanated) silica having a particle size in the rang e from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

Suitable particulate antifoam components are disclosed in Bartollota et al. U.S. Pat. No. 3,933,672.

A highly preferred particulate antifoam component is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate antifoam components wherein the organic carrier material is a fatty acid or alcohol having a carbon chain containing from 12 to 20 carbon atoms, or a mixture thereof, with a melting point of from 45° C. to 80° C.

Other highly preferred particulate antifoam components are described in copending European Application 91870007.1 in the name of the Procter and Gamble Company which components comprise silicone antifoam compound, a carrier material, an organic coating material and glycerol at a weight ratio of glycerol:silicone antifoam compound of 1:2 to 3:1. Copending European Application 91201342.0 also discloses highly preferred particulate antifoam components comprising silicone antifoam compound, a carrier material, an organic coating material and crystalline or amorphous aluininosilicate at a weight ratio of aluminosilicate:silicone antifoam compound of 1:3 to 3:1. The preferred carrier material in both of the above described highly preferred granular suds controlling agents is starch.

An exemplary particulate antifoam component for use herein is a particulate agglomerate component, made by an agglomeration process, comprising in combination (i) from 5% to 30%, preferably from 8% to 15% by weight of the component of silicone antifoam compound, preferably comprising in combination polydimethyl siloxane and silica;

(ii) from 50% to 90%, preferably from 60% to 80% by weight of the component, of carrier material, preferably starch;

(iii) from 5% to 30%, preferably from 10% to 20% by weight of the component of agglomerate binder compound, where herein such compound can be any compound, or mixtures thereof typically employed as binders for agglomerates, most preferably said agglomerate binder compound comprises a $C_{16}$–$C_{18}$ ethoxylated alcohol with a degree of ethoxylation of from 50 to 100; and (iv) from 2% to 15%, preferably from 3% to 10%, by weight of $C_{12}$–$C_{22}$ hydrogenated fatty acid.

The incorporation of silicon e antifoam compounds as components of seperate particulate components also permits the inclusion therein of $C_{20}$–$C_{24}$ fatty acids, microcrystalline waxes and high MWt copolymers of ethylene oxide and propylene oxide which would otherwise adversely affect the despersibility of the matrix. Techniques for forming such particulates are disclosed in U.S. Pat. No. 3,933,672.

A preferred suds suppressing system has the weight ratio of antifoam compound comprised in the spray-on component to antifoam compound comprised in the particulate component of from 5:1 to 1:1, most preferably from 4:1 to 2:1.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types.

Preferred silicone antifoam compounds are the siloxanes having the general structure:

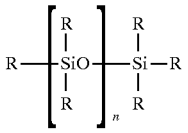

where each R independently can be an alkyl or an aryl radical. Examples of such substituents are methyl, ethyl, propyl, isobutyl, and phenyl. Preferred polydiorganosiloxanes are polydimethylsiloxanes having trimethylsilyl end-blocking units and having a viscosity at 25° C. of from $5\times10^{-5}$ $m^2/s$ to 0.1 $m^2/s$ i.e. a value on n in the range 40 to 1500. These are preferred because of their ready availability and their relatively low cost.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight hydrocarbons such as paraffin, fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about −40° C. and about 5° C., and a minimum boiling point not less than 110° C. (atmospheric pressure). It is also known to utilize waxy hydrocarbons, preferably having a melting point below about 100° C. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin", as used in this suds supressor dicussion, is intended to include mixtures of true paraffins and cyclic hydrocarbons.

Copolymers of ethylene oxide and propylene oxide, particularly the mixed ethoxylated/propoxylated fatty alcohols with an alkyl chain length of from 10 to 16 carbon atoms, a degree of ethoxylation of from 3 to 30 and a degree of propoxylation of from 1 to 10, are also suitable antifoam compounds for use herein.

Suitable 2-alky-alcanols antifoam compounds for use herein have been described in DE 40 21 265. The 2-alkyl-alcanols suitable for use herein consist of a $C_6$ to $C_{16}$ alkyl chain carrying a terminal hydroxy group, and said alkyl chain is substituted in the a position by a $C_1$ to $C_{10}$ alkyl chain. Preferably, the alkyl chain carrying the hydroxy group is a $C_8$ to $C_{12}$ alkyl chain, and the alkyl chain in the a position is a $C_2$ to $C_8$ alkyl chain, most preferably $C_3$ to $C_6$. Preferably all alkyl chains herein are straight. It has been found that 2-hexyl-decanol and 2-butyl-decanol are particularly suitable for use herein. 2-hexyl-decanol and 2-butyl-octanol are commercially available fron Condea under the trade names ISOFOL 16 and ISOFOL 12. The suds suppressing system for use herein comprises from 0.01% to 15% by weight of the total composition of said 2-alkyl-alcanols, preferably from 0.05% to 10%, most preferably from 0.1% to 5%. Mixtures of 2-alkyl-alcanols can be used in the compositions according to the present invention. Such mixtures are comprised in commercially available materials, for instance ISALCHEM 123 R from Enichem.

The machine dishwashing detergent compositions of the invention will preferably included bleaching agent selected from chlorine bleaches, inorganic perhydrate salts, peroxy-acid bleach precursors and organic peryoxacids.

Chlorine bleaches include the alkali metal hypochlorites and chlorinated cyanuric acid salts. The use of chlorine bleaches in the composition of the invention is preferably minimized, and more preferably the compositions contain no chlorine bleach.

The machine dishwashing detergent compositions in accord with the invention will generally include an inorganic perhydrate salt, normally in the form of the sodium salt at a level of from 1% to 40% by weight, more preferably from 2% to 30% by weight and most preferably from 5% to 25% by weight of the detergent compositions.

The machine dishwashing detergent compositions of the present invention will also generally include peroxyacid bleach precursors (bleach activators). The peroxyacid bleach precursors are normally incorporated at a level of from 1% to 20% by weight, more preferably from 1% to 10% by weight, most preferably from 1% to 7% by weight of the compositions.

The machine dishwashing detergent compositions may also contain organic peroxyacids at a level of from 1% to 15% by weight, more preferably from 1% to 10% by weight of the composition.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product.

Sodium perborate, which is the most preferred perhydrate for inclusion in the machine dishwashing detergent compositions in accordance with the invention, can be in the form of the monohydrate of nominal formula $NaBO_2H_2O_2$ or the tetrahydrate $NaBO_2H_2O_2 \cdot 3H_2O$.

Sodium percarbonate, which is another preferred perhydrate for inclusion in detergent compositions in accordance with the invention, is an addition compound having a formula corresponding to $2Na_2CO_3 \cdot 3H_2O_2$, and is available commercially as a crystalline solid. The percarbonate is most preferably incorporated into such compositions in coated form. The most preferred coating material comprises mixed salt of an alkali metal sulphate and carbonate. Such coatings together with coating processes have previously been described in GB-1,466,799, granted to Interox on 9th Mar. 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4 \cdot n \cdot Na_2CO_3$ wherein n is form 0.1 to 3, preferably n is from 0.3 to 1.0 and most preferably n is from 0.2 to 0.5.

Another suitable coating material is sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. Magnesium silicate can also be included in the coating. other suitable coating materials include the alkali and alkaline earth metal sulphates and carbonates.

Potassium peroxymonopersulfate is another inorganic perhydrate salt of particular usefulness in the machine dishwashing detergent compositions.

Peroxyacid bleach precursors for inclusion in the machine dishwashing detergent compositions in accordance with the invention probably contain one or more N- or O- acyl groups, which precursors can be selected from a wide range of classes. Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864798, 1147871 and 2143231 and imides such as are disclosed in GB-A-855735 & 1246338.

Particularly preferred precursor compounds are the N,N, $N^1$,$N^1$ tetra acetylated compounds of formula

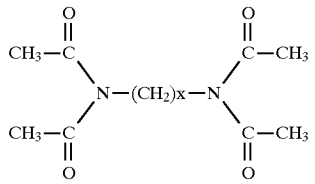

wherein x can be O or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Another preferred class of peroxyacid bleach activator compounds are the amide substituted compounds of the following general formulae:

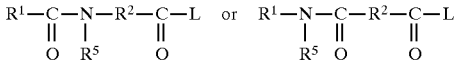

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-0170386.

Other peroxyacid bleach precursor compounds include sodium nonanoyloxy benzene sulfonate, sodium trimethyl hexanoyloxy benzene sulfonate, sodium acetoxy benzene sulfonate and sodium benzoyloxy benzene sulfonate as disclosed in, for example, EP-A-0341947.

The machine dishwashing detergent compositions of the invention may also contain organic peroxyacids of which a particularly preferred class are the amide substituted peroxyacids of general formulae:

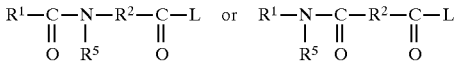

where $R^1$, $R^2$ and $R^5$ are as defined previously for the corresponding amide substituted peroxyacid bleach activator compounds.

Other organic peroxyacids include diperoxy dodecanedioc acid, diperoxy tetra decanedioc acid, diperoxyhexadecanedioc acid, mono- and diperazelaic acid, mono- and diperbrassylic acid, monoperoxy phthalic acid, perbenzoic acid, and their salts as disclosed in, for example, EP-A-0341 947.

Detergent compositions in which solid peroxybleach precursors are protected via an acid coating are disclosed in the Applicant's copending British Application No. 9102507.2 filed Feb. 6, 1991.

Anti-redeposition and soil-suspension agents suitable herein include cellulose derivatives such as methylcellulose, carboxymethylcellulose and hydroxyethylcellulose, homo- or co-polymeric polycarboxylic acids or their salts and polyamino compounds. Polymers of this type include the polyacrylates and copolymers of maleic anhydride with ethylene, methylvinyl ether or methacrylic acid, the maleic anhydride constituting at least 20 mole percent of the copolymer disclosed in detail in EP-A-137669. Polyamino compounds such as those derived from aspartic acid are disclosed in EP-A-305282, EP-A-305283 and EP-A-351629. These materials are normally used at levels of from 0.5% to 10% by weight, more preferably; from 0.75% to 9%, most preferably from 1% to 8% by weight of the composition.

Other useful polymeric materials are the polyethylene glycols, particularly those of molecular weight 1000–10000, more particularly 2000 to 8000 and most preferably about 4000. These are used at levels of from 0.2% to 5% by weight, more preferably from 0.25% to 2.5% by weight. These polymers and the previously mentioned homo-co-polymeric polycarboxylate salts are valuable for reducing ash deposition, and improving cleaning performance on clay, proteinaceous and oxidizable soils in the presence of transition metal impurities.

Another optional ingredient useful in detergent compositions is one or more enzymes.

Preferred additional enzymatic materials include the commercially available amylases, neutral and alkaline proteases, and, esterases conventionally incorporated into detergent compositions. Suitable enzymes are discussed in U.S. Pat. Nos. 3,519,570 and 3,533,139.

Preferred commercially available protease enzymes include those sold under the tradenames Alcalase and Savinase by Novo Industries A/S (Denmark) and Maxatase by International Bio-Synthetics, Inc. (The Netherlands). Protease enzyme may be incorporated into the compositions in accordance with the invention at a level of from 0.005% to 2% active enzyme by weight of the composition.

Preferred amylases include, for example, &-amylases obtained from a special strain of B licheniforms, described in more detail in GB-1,269,839 (Novo). Preferred commercially available amylases include for example, Rapidase, sold by International Bio-Synthetics Inc, and Termamyl, sold by Novo Industries A/S. Amylase enzyme may be incorporated into the composition in accordance with the invention at a level of from 0.001% to 2% active enzyme by weight of the composition.

Enzyme Stabilizing System

Preferred enzyme-containing compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof.

The compositions herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in solid-form composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Corrosion Inhibitor

The present compositions may also contain corrosion inhibitor, preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50; preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminium tristearate. The $C_{12}$–$C_{20}$ hydroxy fatty acids, or their salts, are also suitable. Phosphonated octa-decane and other anti-oxidants such as betahydroxytoluene (BHT) are also suitable.

Heavy Metal Ion Sequestrant

The detergent compositions of the invention may be formulated to contain as a non-essential component heavy metal ion sequestrant, incorporated at a level of from 0.005% to 3%, preferably 0.05 to 1%, most preferably 0.07% to 0.4%, by weight of the total composition.

Suitable heavy metal ion sequestrant for use herein include organic phosphonates, such as amino alkylene poly (alkylene phosphonate), alkali metal ethane 1-hydroxy disphosphonates, nitrilo trimethylene phosphonates.

Preferred among above species are diethylene triamine penta (methylene phosphonate), hexamethylene diamine tetra (methylene phosphonate) and hydroxy-ethylene 1,1 diphosphonate.

The phosphonate compounds may be present either in their acid form or as a complex of either an alkali or alkaline metal ion, the molar ratio of said metal ion to said phosphonate compound being at least 1:1. Such complexes are described in U.S. Pat. No. 4,259,200. Preferably, the organic phosphonate compounds are in the form of their magnesium salt.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid or the water soluble alkali metal salts thereof. Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof. Examples of such preferred sodium salts of EDDS include $Na_2$EDDS and $Na_3$EDDS. Examples of such preferred magnesium complexes of EDDS include MgEDDS and $Mg_2$EDDS. The magnesium complexes are the most preferred for inclusion in compositions in accordance with the invention.

Still other suitable heavy metal ion sequestrants for use herein are iminodiacetic acid derivatives such as 2-hydroxyethyl diacetic acid or glyceryl imino diacetic acid, described in EPA 317 542 and EPA 399 133.

The heavy metal ion sequestrant herein can consist of a mixture of the above described species.

Other optional ingredients suitable for inclusion in the compositions of the invention include perfumes, colours and filler salts, with sodium sulfate being a preferred filler salt.

The machine dishwashing or rinsing compositions of the invention can be formulated in any desirable form such as powders, granulates, pastes, liquids, gels and tablets.

In general, granular machine dishwashing or rinsing detergent compositions in accordance with the present invention can be made via a variety of methods including dry mixing, spray drying, agglomeration and granulation. A preferred method of making the granular machine dishwashing compositions involves a combination of dry mixing and agglomeration techniques.

The bulk density of the granular detergent compositions in accordance with the present invention typically have a bulk density of at least 650 g/liter, more usually at least 700 g/liter and more preferably from 800 g/liter to 1200 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindrial cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

The particle size of the components of granular compositions in accordance with the invention should preferably be such that no more that 5% of particles are greater than 1.4 mm in diameter and not more than 5% of particles are less than 0.15 mm in diameter.

Generally, if the machine dishwashing or rinsing detergent compositions are in liquid form the liquid should be thixotropic (ie; exhibit high viscosity when subjected to low stress and lower viscosity when subjected to high stress), or at least have very high viscosity, for example, of from 1,000 to 10,000,000 centipoise. In many cases it is desirable to include a viscosity control agent or a thixotropic agent to provide a suitable liquid product form. Suitable thixotropic or viscosity control agents include methyl cellulose, carboxymethylcellulose, starch, polyvinyl, pyrrolidone, gelatin, colloidal silica, and natural or synthetic clay minerals.

Pasty compositions in accordance with the invention generally have viscosities of about 5,000 centipoise and up to several hundred million centipoise. In order to provide satisfaction pasty compositions a small amount of a solvent or solubilizing agent or of a gel-forming agent can be included. Most commonly, water is used in this context and forms the continuous phase of a concentrated dispersion. Certain nonionic surfactants at high levels form a gel in the presence of small amount of water and other solvents. Such gelled compositions also envisaged in the present invention.

In the detergent compositions, the abbreviated component identifications have the following meanings:

Citrate: Tri-Sodium citrate dihydrate

Phosphate: Sodium tripolyphosphate

MA/AA: Copolymers of 1:4 maleic/acrylic acid, average molecular weight about 80,000

Silicate: Amorphous Sodium Silicate ($SiO_2$:$Na_2O$ ratio normally follows)

Carbonate: Anhydrous sodium carbonate

Protease: Proteolytic enzyme sold under the tradename Savinase by Novo Industries A/S Amylase: Amylolytic enzyme sold under the tradename Termamyl by Novo Industries A/S Lipase: Lipolytic enzyme obtained from a lipase producing strain of *Pseudomonas pseudoalcaligenes*

Nonionic: $C_{13}$–$C_{15}$ mixed ethoxylated/propoxylated fatty alcohol with an average degree of ethoxylation of 3.8 and an average degree of propoxylation of 4.5 sold under the tradename Plurafac LF404 by BASF Gmbh.

Sulphate: Anhydrous Sodium Sulphate

Perborate: anhydrous sodium parborate monohydrate bleach, empirical formula $NaBO_2 \cdot H_2O$ TAED: Tetraacetyl ethylene diamine SCS: Sodium cumene sulphonate Dobanol: A blend of $C_{12}$–$C_{15}$ ethoxylated alcohols with an average degree of ethoxylation of 9, sold under the tradename Dobanol 25.9 by Shell Chemicals (UK) Ltd LSD1: A blend of $C_{13}$–$C_{15}$ ethoxylated alcohols with an average degree of ethoxylation of 30, sold under the tradename Lutensol A030 by BASF GmbH.

LSD2: A blend of $C_{13}$–$C_{15}$ ethoxylated alcohols with an average degree of ethoxylation of 12, sold under the tradename Lutensol A012 by BASF GmbH.

LSD3: $C_{13}$–$C_{15}$ alkyl ethoxysulfate with a degree of ethoxylation of 3

Suds Suppressor: 12% silicone/silica, 18% stearyl alcohol, 70% starch, in granular form.

EXAMPLE 1

The following machine dishwashing detergent compositions were prepared (parts by weight) in accord with the invention.

| | A | B | C | D | E |
|---|---|---|---|---|---|
| Citrate | 24.0 | — | — | 24.0 | 24.0 |
| Phosphate | — | 46.0 | 46.0 | — | — |
| MA/AA | 6.0 | — | — | 6.0 | 6.0 |
| Silicate (2.0 ratio) | 27.5 | 33.0 | 33.0 | 27.5 | 27.5 |
| Carbonate | 12.5 | — | — | 12.5 | 12.5 |
| Perborate | 10.4 | 10.4 | 10.4 | 10.4 | 10.4 |
| TAED | 3.0 | 3.0 | 3.0 | 3.0 | 3.0 |
| Protease | 2.2 | 2.2 | 2.2 | 2.2 | 2.2 |
| Amylase | 2.0 | 1.5 | 1.5 | 1.5 | 1.5 |
| Lipase | 2.65 | 2.65 | 2.65 | 2.65 | 2.65 |
| Nonionic | — | 1.5 | 1.5 | 1.5 | 1.5 |
| Sulphate | 1.4 | 2.4 | 2.4 | 12.1 | 12.1 |
| Dobanol | 6.5 | — | — | — | — |
| SCS | 3.5 | — | — | — | — |
| LSD1 | 4.0 | — | — | — | — |
| LSD2 | — | 5.0 | — | 5.0 | — |
| LSD3 | — | — | 5.0 | — | 5.0 |
| Suds suppressor | 1.0 | — | — | — | — |

(NB: formulations do not always add up to 100)

The compositions provide good detergency, and spotting/filming prevention performance when used in a machine dishwashing process.

What is claimed is:

1. A method of cleaning soiled dishes comprising the step of treating said dishes in an automatic dishwashing machine with a composition comprising:

(a) from 0.1% to 40% by weight of a lime soap dispersant which has a lime soap dispersing power of no more than 8 and which is selected from the group consisting of:

i) water-soluble salts of copolymers of acrylic acid, methacrylic acid, acrylamide and mixtures thereof, wherein said copolymers have a molecular weight of from 5,000 to 20,000 and do not demonstrate surfactant capability; and ii) surfactant lime soap dispersants selected from the group consisting of $C_{16}$ to $C_{18}$ dimethyl amine oxides, betaines and sulfobetaines;

(b) from 0.001% to 2% by weight of active lipolytic enzyme obtained from a lipase-producing strain of *pseudomonas pseudoalcaligenes;*

(c) from 20% to 60% of a water-soluble detergent builder compound selected from the group consisting of silicates, carbonates and mixtures thereof; and (d) from 0.01% to 15% of a suds suppressing system comprising a silicone, 2-alkyl alcanol, or mixture.

2. The method of claim 1 wherein the said composition contains no chlorine bleach.

3. The method of claim 1 wherein the lime soap dispersant has a lime soap dispersing power of no more than 7.

4. A method according to claim 1 wherein the composition further comprises from 0.1% to 50% by weight of a surfactant system in addition to any lime soap dispersant that is present and functioning as a surfactant.

5. A method according to claim 1 wherein the suds suppressing system contains a silicone.

6. A method according to claim 1 wherein the suds suppressing system contains a 2-alkyl alcanol antifoam compound.

7. A method according to claim 1 wherein the composition further comprises bleaching agents selected from the group consisting of:

(a) inorganic perhydrate salts present at a level of from 1% to 40% by weight of the composition;

(b) peroxyacid bleach precursors present at a level of from 1% to 20% by weight of the composition;

(c) organic peroxyacids at a level of from 1% to 15% by weight of the composition; and (d) mixtures of said bleaching agents.

8. A method according to claim 1 wherein the detergent composition additionally comprises enzymes selected from the group consisting of:

(a) neutral and alkaline proteases at a level of from 0.005% to 2% active enzyme by weight of the composition;

(b) amylases at a level from 0.001% to 2% active enzyme by weight of the composition; and (c) mixtures of said enzyme.

9. A method according to claim 1 wherein the detergent composition further comprises from 0.5% to 25% by weight of a hydrotrope.

* * * * *